United States Patent [19]

Cushing

[11] 4,355,217

[45] Oct. 19, 1982

[54] SWITCH INHIBITOR FOR TIMERS

[75] Inventor: Donald S. Cushing, Louisville, Ky.

[73] Assignee: General Electric Company, Louisville, Ky.

[21] Appl. No.: 223,078

[22] Filed: Jan. 7, 1981

[51] Int. Cl.[3] ..... H01H 43/10

[52] U.S. Cl. ..... 200/38 R; 200/38 A; 200/38 B; 200/38 C; 200/39 R

[58] Field of Search ..... 200/27 R, 27 B, 27 BA, 200/30 R, 37 A, 38 A, 38 F, 38 FA, 38 B, 38 BA, 38 C, 38 CA, 39 R, 39 A, 153 L, 153 LA, 153 LB, 153 M, 61.19

[56] References Cited

U.S. PATENT DOCUMENTS

| | | | |
|---|---|---|---|
| 296,812 | 4/1884 | Blake | 200/161 |
| 503,867 | 8/1893 | Matson | 200/2 |
| 644,128 | 2/1900 | Christensen | 361/210 |
| 690,364 | 12/1901 | Gaffney | 200/2 |
| 950,107 | 2/1910 | Larsson | 179/96 |
| 2,472,818 | 6/1949 | Gardes | 200/39 A |
| 2,786,907 | 3/1957 | Harris | 200/30 R X |
| 3,123,682 | 3/1964 | Byl | 200/38 B |
| 4,146,760 | 3/1979 | Voland | 200/38 A |

FOREIGN PATENT DOCUMENTS

| | | | |
|---|---|---|---|
| 49885 | 9/1966 | Fed. Rep. of Germany | 200/153 M |
| 1217162 | 12/1959 | France | 200/153 M |

*Primary Examiner*—James R. Scott
*Attorney, Agent, or Firm*—Radford M. Reams

[57] ABSTRACT

An electromechanical timer arrangement includes a rotatable cam having a cam surface for actuating an associated switch. An inhibit member is movable between an active position and an idle position. In its active position, the member engages the switch and prevents cam actuation of the switch. In its idle position, the member permits normal cam actuation of the switch. In controlling a dishwasher the active and idle positions are user-selected non-heated and heated drying cycles and the switch controls energization of the heater. The cam surface is contoured to close the switch for heated drying. Moving the member to its active position opens the switch, regardless of the cam position, for non-heated drying.

11 Claims, 6 Drawing Figures

SWITCH INHIBITOR FOR TIMERS

BACKGROUND OF THE INVENTION

Modern automatic dishwashers generally provide an energy saving drying option which permits the user to select heated drying or non-heated drying. When operating in the heated drying mode the heating element is energized during the timed drying cycle to speed up the drying process for the just-washed dishes. In the non-heated drying mode, the heating element is not heated during the drying cycle. In dishwashers known in the art, this option is provided by simply placing a user-actuable option selection switch in series with the heating element and the cam-actuated switch. The timer control cam which actuates the heater switch operates the same way regardless of which option is selected to close the heater cam switch at the beginning of the dry cycle. To select heated drying, the user closes the option selector switch and the heater is energized under control of the timer. To select the non-heated drying option, the user opens the option selection switch, preventing energization of the heater during the drying cycle even though the heater control switch is closed at the beginning of the drying cycle.

This conventional approach provides satisfactory results. However, it requires the addition of a manually operable switch capable of handling current on the order of 10 amps. Additionally, such an arrangement requires that additional switches be employed to bypass the option selection switch if it is desired to energize the heating element during the wash cycles independently of which dry cycle option is selected.

It is desirable to provide an electromechanical timer for appliances which enables the user, at his option, to selectively inhibit the control cam without adding additional external switches to the control circuit.

It is therefore an object of the present invention to provide an electromechanical timer for appliances, such as dishwashers, which permits the user to selectively inhibit switch actuation by the heater control cam to prevent heater energization when the non-heated drying cycle is selected without the need for additional switches.

It is a further object of the present invention to provide an electromechanical timer for appliances such as dishwashers in which the primary switch actuating cam is inhibited by selectively transferring cam actuation to an auxiliary cam which permits actuation of the timer by the primary cam during the wash cycle and by the secondary cam during the drying cycle.

SUMMARY OF THE INVENTION

The invention provides an electromechanical timer such as may be used to control sequential operation of the appliance which includes means for selectively inhibiting actuation of one or more of the timer switches by the timer cam.

In accordance with one aspect of the invention, the timer includes an inhibit member which is movable by the user between an active position and an idle position. In the active position, the inhibit member engages the resilient cam-following contact arm of at least one of the cam-actuated timer switches and prevents closure of the switch. In the idle position, the inhibit member is remote from the contact arm permitting it to follow its associated cam surface for actuation in accordance with the contour of the cam surface. In an illustrative embodiment, the timer switch is adapted to control energization of the heating element of a dishwasher. The user selects between a non-heated drying cycle option and a heated drying cycle option by placement of the inhibit member in its active position or its idle position, respectively. The cam surface associated with the heater switch is contoured to actuate the heater switch as desired for the heated drying option. With the inhibit member in its idle position, energization of the heater is controlled by the cam surface to provide the heated drying cycle option. With the inhibit member in its active position, the heater switch is held in its open position, preventing energization of the heater and thereby providing the non-heated drying cycle option.

In accordance with another aspect of the present invention, the inhibit member is movable between an inhibit position in which closure of at least one of the cam-actuated timer switches is prevented and a clear position in which cam actuation of the switch by its associated cam surface is permitted. Option selection means is provided to enable the user to select between first and second operating cycle options. The option selection means is coupled to the inhibit member by bias means operative to bias the inhibited member into cam-following engagement with an inhibit cam surface of the control cam when the first operating cycle is selected and to relax this bias when the second operating cycle option is selected. When biased, the inhibit member is moved between its inhibit position and its clear position under the control of the inhibit cam surface, and cam actuation of the switch is inhibited, as determined by the inhibit cam surface. When the inhibit member is unbiased, cam actuation of the cam-actuated switch by its associated cam surface is not inhibited.

In an illustrative embodiment of this aspect of the invention, the cam-actuated switch is adapted for controlling heater energization in a dishwasher. The switch actuating cam surface is contoured to energize the heater as required for the heated drying option. The inhibit cam surface is contoured to permit uninhibited cam actuation of the heater switch during the wash cycle, and to inhibit heater energization during the drying cycle as required for the energy-saving cycle option. The inhibit cam can be contoured to inhibit heater switch actuation throughout the drying cycle for totally non-heated drying, or to inhibit heater switch actuation during a predetermined portion of the drying cycle or intermittently during the drying cycle, if preferred.

When the heated drying option is selected by the user, the inhibit member is unbiased and has no effect on heater energization. Actuation of the heater switch is controlled solely by its associated cam surface. Selection of the energy-saving option by the user causes the inhibit member to the biased into cam-following engagement with the inhibit cam surface causing cam actuation of the heater switch to be inhibited by the inhibit member under the control of the inhibit cam surface, so that energization of the heater is as required for the energy-saving option.

DETAILED DESCRIPTION

The present invention is directed to electromechanical timers for controlling the sequential actuation of switches. The illustrative embodiments described herein are for application in timers for automatic dishwashers, an application for which this invention is particularly well suited. It is to be understood, however, that the invention may be useful for many other applications requiring timer controlled switch actuation.

Figure 1:
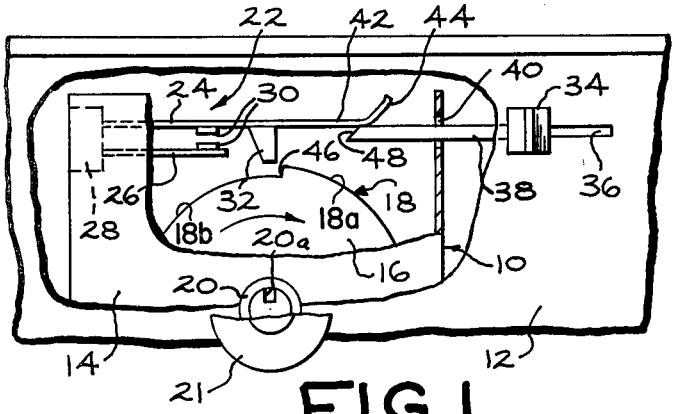
FIG. 1 is a partial front elevational view of a control panel and timer for a dishwasher with portions cut away to show the internal structure of a first embodiment of the timer of the present invention with the selection handle in its first position.
Figure 2:
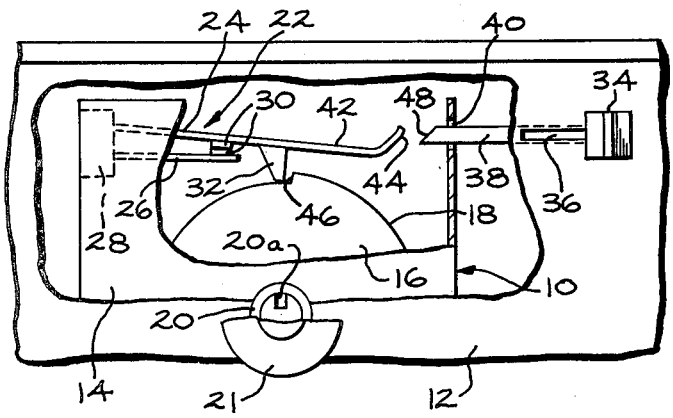
FIG. 2 is a partial view of the control panel and timer of as shown in FIG. 1 but showing the selection handle in its second position.

Referring now to FIGS. 1 and 2, an electromechanical timer 10 is mounted behind the control panel 12 of a dishwasher in a conventional manner by any suitable mounting means. Structural support for timer 10 is primarily provided by housing or frame 14. A control cam 16 having at least one control cam surface 18 on its periphery is carried on a shaft 20 which is rotatably mounted to housing 14. Timer control knob 21 is suitably mounted to shaft 20 with key (not shown) which is received in slot 20*a* of shaft 20. Control cam 16 is rotatably driven in the clockwise direction, as seen in FIG. 1, by a conventional timer motor (not shown) coupled to cam 16 by a gear train (not shown) in a conventional manner well known in the art.

A cam-actuated control switch, designated generally 22, comprises a pair of contact arms 24 and 26 extending from terminal block 28, suitably secured to frame 14 by control cam 16. Each of arms 24 and 26 of switch 22 carries an electrical contact 30. Contact arm 24, in addition, carries a cam follower 32 extending therefrom for tracking control cam surface 18. Contact arm 24 is movable between a first or open position as shown in FIG. 1, in which the contact 30 of arm 24 is remote from contacts 30 of arm 26, and a second or closed position as shown in FIG. 2 with contacts 30 in mutual electrical contact. The inherent resilience of contact arm 24 biases cam follower 32 toward its closed position and against control cam surface 18. Control cam surface 18 includes a radially higher portion 18*a* and a radially lower portion joining at a shoulder 46. When follower 32 is in register with the higher cam surface portion 18*a* the contacts 30 are in their open position, similar to FIG. 1. When follower 32 is in register with the lower cam surface portion 18*b* the contacts 30 are in their closed position, as shown in FIG. 2. The option selection means to be described hereinafter acts to retain the contacts 30 in their open configuration regardless of which portion of cam surface 18 is adjacent follower 32. It is to be understood that while only one switch 22 and only one control cam surface 18 is shown in FIGS. 1 and 2, timer 10 typically includes a plurality of switches similar to switch 22 extending from terminal block 28 for actuation by control cam 16. Similarly, control cam 16 typically comprises a plurality of control surfaces which parallel surface 18 for actuating the additional switches. Each cam surface is contoured for the desired sequential actuation of its associated cam-actuated switch. The timer structure and operation described thus far is typical of electromechanical timers well known in the art.

In accordance with the present invention, timer 10 includes option selection means movable between a first or non-heated drying position and a second or heated drying position and operative in the first position to inhibit cam actuation of at least one of the cam-actuated switches by preventing closure of the cam-actuated switch and in the second position to permit cam actuation of the switch.

In accordance with one aspect of the invention, the option selection means comprises a selection member and an inhibit member. The selection member is arranged for manual movement between an active position corresponding to the first position of the option selection means and an idle position corresponding to the second position of the option selection means. The inhibit member comprises a rigid member projecting from the selection member. When the selection member is in its active position, this rigid member extends into the path of the cam following contact arm of the cam-actuated switch to engage the contact arm and inhibit movement of the contact arm to its closed position. When the selection member is in its idle position, the rigid member is remote from the contact arm, leaving the contact arm free to follow the contour of the associated control cam surface.

In the illustrative embodiment of FIGS. 1 and 2, timer 10 incorporates an inhibit member comprising a rigid elongated finger 38 formed of plastic or other non-conductive material, which projects through an opening 40 in frame 14 into the interior of timer 10, and a neck portion (not shown) which projects outwardly from within control panel 12 through slot 36 formed in the control panel. Control handle 34 is suitably secured to the neck of the inhibit member such as by press fitting. The inhibit member is mounted for sliding movement in slot 36 between its active position with the handle 34 at the left end of slot 36, as seen in FIG. 1, and its idle position with handle 34 at the right end of slot 36, as seen in FIG. 2.

Contact arm 24 of switch 22 includes an extension 42 which extends beyond cam follower 32 toward finger 38 and terminates in upturned tab 44. End portion 48 of finger 38 is sloped to complement the contour of tab 44. As best seen in FIG. 1, when control handle 34 is in its active position, finger 38 engages extension 42 of contact arm 24 to inhibit cam actuation of switch 22 by preventing contact arm 24 from dropping into contact with contact arm 26 as cam follower 32 passes over shoulder 46 of control cam surface 18. As shown in FIG. 2, when control handle 34 is in its idle position, finger 38 is remote from extension 42 of contact arm 24, and contact arm 24 is free to move into electrical contact with arm 26 as cam follower 32 drops over shoulder 46 of cam surface 18.

Upturned tab 44 of extension 42 cooperates with sloped end portion 48 of finger 38 to insure proper engagement when control handle 34 is moved to its active position. By this arrangement switch 22 may be opened by movement of control handle 34 to its active position, enabling the user to change his option selection any time during operation of the appliance.

In this embodiment, switch 22 is adapted for coupling the heating element (not shown) of the dishwasher to the power supply to control energization of the heating element. When switch 22 is closed, the heating element energizing circuit is closed. When switch 22 is open, the heating element circuit is open. shoulder 46 is formed in control surface 18 to permit switch 22 to close at the desired time in the drying cycle to provide the heated drying option. Typically, shoulder 46 would be positioned to permit switch 22 to close at the beginning of the drying cycle.

Operation of the embodiment of FIGS. 1 and 2 will now be briefly described. To select the heated drying option, the user moves handle 34 to the right to its idle position as shown in FIG. 2. In this position, inhibit member 38 is removed from the path of extension 42 of contact arm 24. Contact arm 24 is free to respond to control cam surface 18 which is contoured to provide the heated drying option. As the operating cycle progresses, control cam 16 rotates clockwise. As shoulder 46 passes beneath cam follower 32, cam follower 32 drops below shoulder 46 closing switch 22 thereby energizing the dishwasher heating element. To select the non-heated drying option, the user moves handle 34 to the left to its active position, as shown in FIG. 1. In this position, finger 38 engages extension 42 and inhibits cam actuation of switch 22 by preventing contact arm 24 from moving into electrical contact with contact arm 26. Thus, as cam follower 32 passes over shoulder 46, switch 22 remains open and energization of the heating element is prevented. As long as handle 34 is in its active positon, finger 38 will prevent switch 22 from closing regardless of the contour of control cam surface 18.

Normally, the drying option selection is made at the beginning of the appliance operating cycle. However, the non-heated drying option may be selected while switch 22 is closed such as during the drying cycle. To select the non-heated drying option, handle 34 is moved to its active position as before. As handle 34 approaches its active position, sloped end 48 of finger 38 engages upturned tab 44 and moves contact arm 24 upwardly out of electrical contact with arm 26, thereby opening switch 22 and preventing further energization of the heater.

It is apparent that the aspect of the present invention illustrated by the embodiment of FIGS. 1 and 2 provides the energy-saving, non-heated drying option while eliminating the need for any additional switches in the heating element power circuit external to the timer. This substitution of a simple molded plastic part for a relatively heavy duty electrical switch provides significant cost advantage.

However, in the embodiment of FIGS. 1 and 2, the cam controlled switch is held open throughout the entire dishwasher operating cycle when the non-heated drying option is selected. If heat is desired during the wash cycle, an additional cam-actuated switch controlled by another control cam surface must be used to control heater energization during the wash cycle.

In accordance with an other aspect of the invention, a timer is provided in which an inhibit member selectively permits cam actuation of the cam-actuated switch certain during portions of the operating cycle and inhibits the cam actuation during other portions of the operating cycle. For example, in the illustrative embodiment described next, when the non-heated drying option is selected, the inhibit member permits the heater switch to respond normally to its associated control cam surface, during the wash cycle, inhibiting cam actuation of the heater switch only during the drying cycle or some predetermined portion thereof. This timer arrangement allows the heater to be energized during the wash cycle in the same manner, regardless of which drying cycle option is selected, using only a single heater control switch.

In accordance with this aspect of the invention, the inhibit member is mounted to the timer frame for movement between an inhibit position and a clear position under the control of a second control cam surface of the timer control cam, designated an inhibit cam surface. In its inhibit position, the inhibit member is operative to inhibit cam actuation of the cam-actuated switch by engaging and holding the contact arm of the switch in its open position. In its clear position, the inhibit member disengages the contact arm, permitting the contact arm to follow its associated control cam surface.

When the first operating cycle option, such as an energy-saving drying cycle option, is selected, bias means coupling the option selection means with the inhibit member biases the inhibit member into cam-following engagement with the inhibit cam surace. When so biased, movement of the inhibit member between its inhibit position and its clear position is controlled by the inhibit cam surface. When the second operating cycle option, such as a heated drying option, is selected, the inhibit member is unbiased. When unbiased, the inhibit member permits uninhibited cam-actuation of the switch by its associated control cam surface.

Figure 3:
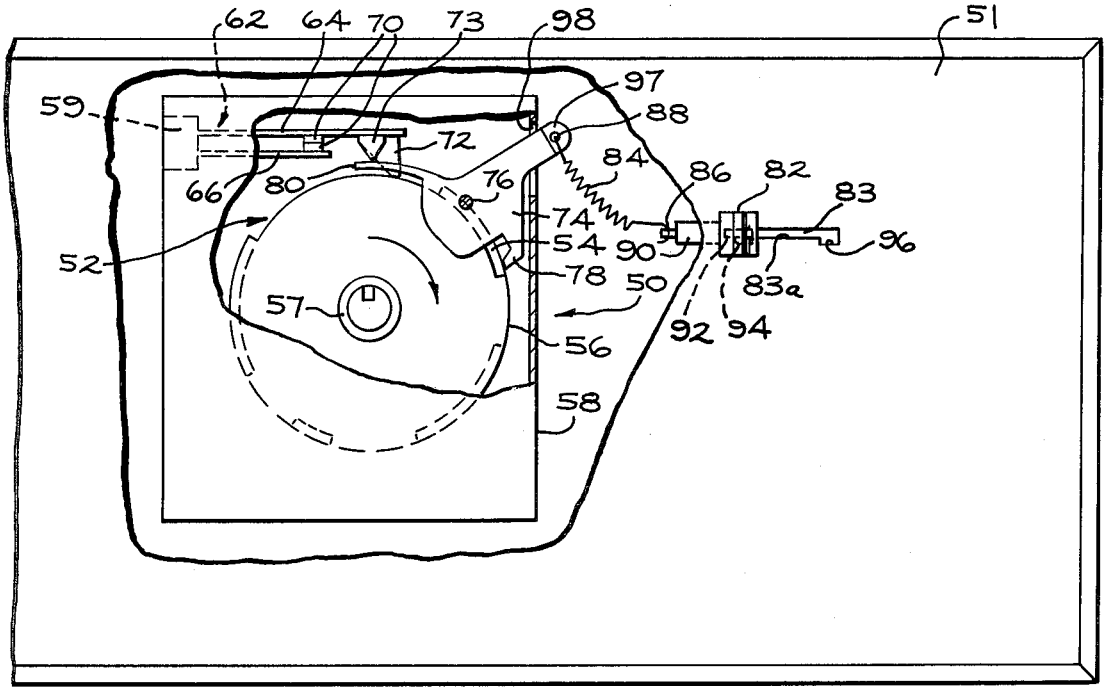
FIG. 3 is a partial front elevational view of a control panel and timer for a dishwasher with portions cut away to show the internal structure of a second embodiment of the timer of the present invention, with the selection means in its idle position.

Referring now to FIGS. 3–6, a timer 50 illustratively embodying this aspect of the invention will be described. Timer 50 is mounted behind control panel 51 of a dishwasher by any suitable mounting means. A control cam 52 having a plurality of cam surfaces, including cam surfaces 54 and 56 carried on its periphery, is carried on shaft 57 which is rotatably mounted to timer housing 58. Control cam 52 is rotatably driven in the clockwise direction as seen in FIG. 3 by a conventional timer motor (not shown) coupled to cam 52 by a train of gears (not shown) in a conventional manner well known in the art.

Figure 6:
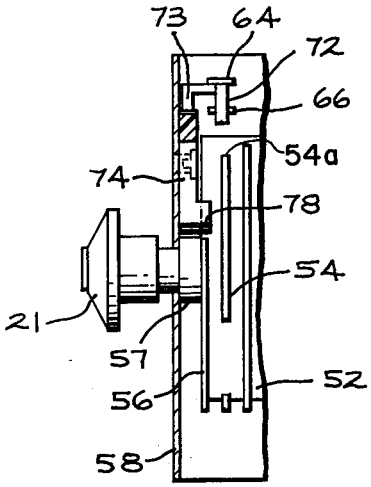
FIG. 6 is a partial cross-sectional view of the control panel and timer of FIG. 5 taken along line 6—6.

A cam-actuated control switch designated generally 62 comprises a pair of contact arms 64 and 66 extending from a terminal block 59 suitably mounted in housing 14 for actuation by control cam 52. As best seen in FIG. 6, control cam 52 includes a plurality of cam surfaces including cam surface 54 which is arranged to control actuation of switch 62. It is to be understood that timer 50 typically includes a plurality of switches positioned similarly to switch 62 for actuation by control cam 52. The additional switches are not essential to the invention, however, and are omitted from the drawings for clarity.

Each of arms 64 and 66 of switch 62 carries an electrical contact 70. Contact arm 64 carries a cam follower 72 extending therefrom for tracking associated switch-actuating control cam surface 54, and tab 73 extending laterally therefrom for engagement with an inhibit member 74. The inherent resilience of arm 64 biases cam follower 72 against control cam surface 54.

Figure 4:
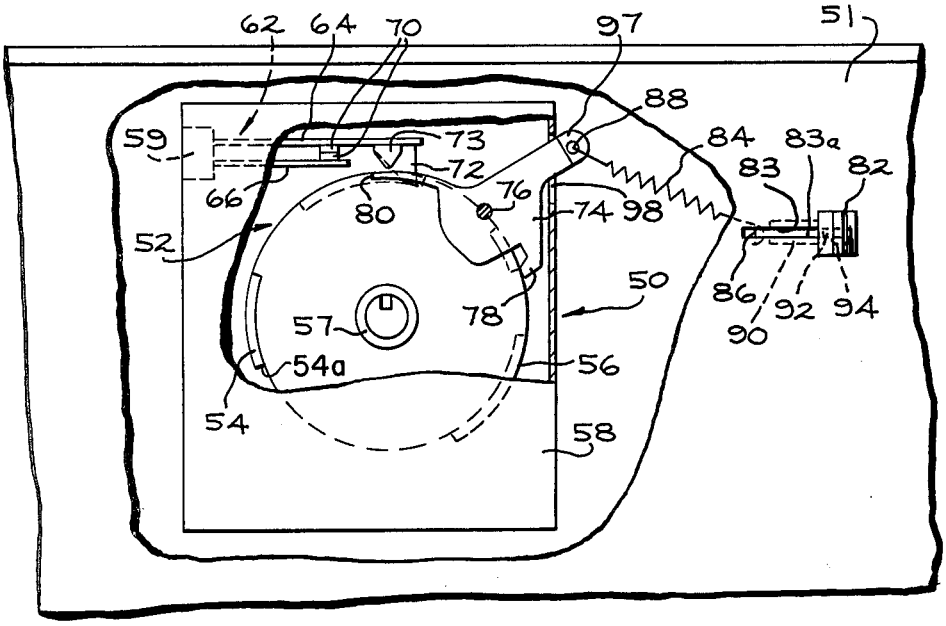
FIG. 4 is a partial view as shown in FIG. 3 but showing the selection means in its active position and the inhibit member in its clear position.
Figure 5:
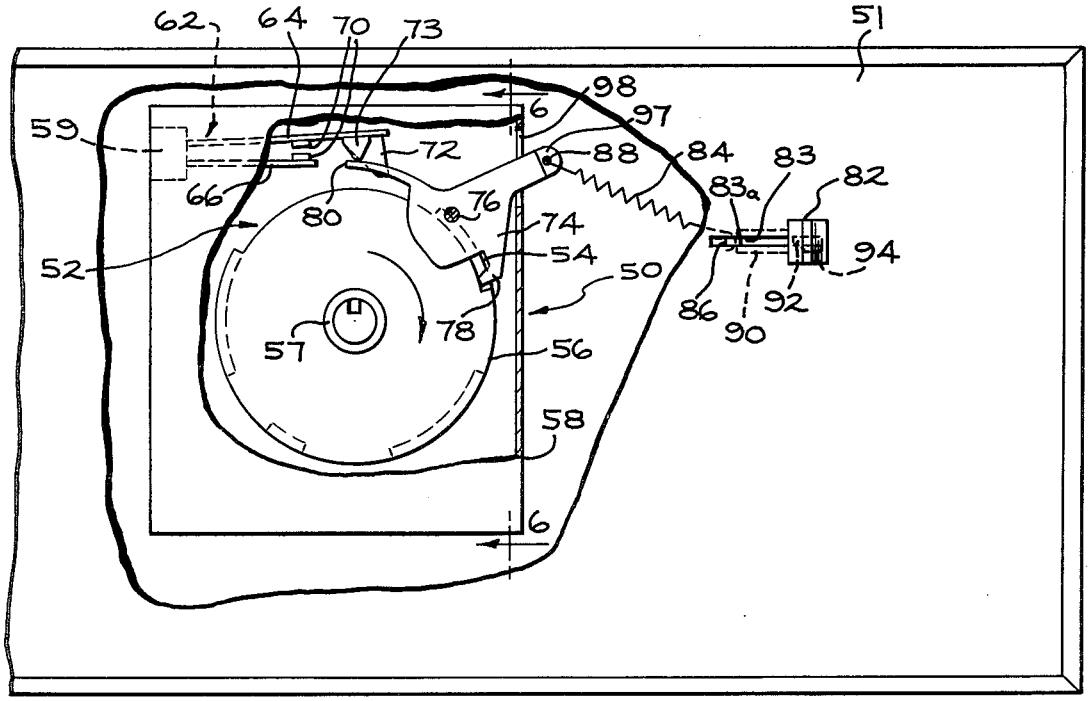
FIG. 5 is a partial view as shown in FIG. 4 but showing the inhibit member in its inhibit position.

Inhibit member 74 is mounted to timer housing 58 by pin 76 for pivotal movement between an inhibit position shown in FIGS. 5 and 6, and a clear position shown in FIGS. 3 and 4. Inhibit member 74 includes a cam follower 78, and an inhibit arm 80. As best seen in FIG. 6, cam follower 78 is arranged to follow inhibit cam surface 56 which is formed on the periphery of control cam 52 adjacent cam surface 54. Inhibit arm 80 extends into the path of tab 73. When inhibit member 74 is in its inhibit position, inhibit arm 80 engages table 73 to hold contact arm 64 in its open position. When inhibit member 74 is in its clear position, inhibit arm 80 disengages tab 73 permitting contact arm 64 to follow cam surface 54.

The option selection means of this embodiment comprises a selection member 90 which includes a neck portion 92 extending from selection member 90 through slot 83 formed in control panel 51. A control handle 82 is suitably secured to neck 92 as by press fitting. Selection member 90 is mounted for sliding movement between an active position with the handle 82 to the right, as seen in FIG. 5, and an idle position with handle 82 to the left, as seen in FIG. 3.

A resilient retaining member 94 is suitably secured to neck 92 and rides against the inner surface of control panel 51 as handle 82 moves between its active and idle position. As handle 82 reaches its active position, retaining member 92 engages in a lateral extension 96 in slot wall 83*a* to retain the inhibit member in its active position. The retaining force exerted by retaining member 94 is easily overcome by the user by moving handle 82 toward its idle position.

Bias means in the form of extension spring 84 couples inhibit member 74 to selection member 90. Spring 84 is connected between tab 86 projecting from selection member 90 and eyelet 88 of inhibit member 74. Eyelet 88 is formed in an extension 97 of inhibit member 74 which projects through opening 98 in housing 58. Movement of handle 82 to its active position (FIG. 5) extends spring 84. The resulting spring tension biases cam follower 78 of inhibit member 74 into cam-following engagement with inhibit cam surface 56. Movement of handle 82 to its idle position (FIG. 3) relaxes the spring tension, removing the biasing force from cam follower 78.

When control handle 82 is in its active position, the bias resulting from the tension in the spring is sufficient to overcome the bias of contact arm 64 applied to inhibit arm 80 by tab 73 and hold contact arm 64 in its open position. When the bias due to spring 84 is relaxed, no force is exerted by inhibit arm 80 against tab 73 and inhibit member 74 permits actuation of switch 62 by its associated cam surface 54.

As in the embodiment of FIG. 1 previously described herein, cam-actuated switch 62 is adapted for switchably coupling the dishwasher heating element (not shown) to a power supply (not shown) to control energization of the heating element. Control cam surface 54 is contoured to control heater energization in accorance with the normal heated drying cycle, which typically calls for the heater to be energized throughout the entire drying cycle. Control handle 82 is moved by the user to its active position to select the non-heaed drying option and to its idle position to select the heated drying option.

When the heated drying option is selected by the user, actuation of switch 62 is controlled by cam surface 54, with contact arm 64 opening and closing switch 762 in accordance with movement of cam follower 72. When the non-heated drying option is selected, actuation of switch 62 is controlled by cam surface 54 when the inhibit member is in its clear position and inhibited when the hinhibit member is in its inhibit position. When cam surface 56 is high, inhibit member 73 is held in its clear position, that is rotated counterclockwise about pin 76 as shown in FIG. 4. When cam surface 56 is low, inhibit member 73 is pivoted by the bias of spring 84 into its inhibit position, that is rotated clockwise about pin 76 as shown in FIG. 5. By properly configuring the contour of cam surface 56, acuation of switch 62 is controlled by cam surface 54 throughout the wash cycle regardless of which drying option is selected. Additionally, the cam surface 56 can be contoured to cause inhibit member 73 to inhibit heater switch actuation throughout the drying cycle, or during any portion of the drying cycle when the energy-saving drying cycle is selected.

Operation of timer 50 will now be described. To select the heated drying option, the user moves control handle 82 to the left to its idle position (FIG. 3). When handle 82 is in this position, spring 84 is relaxed and no biasing force is applied to inhibit member 74 to overcome the resilient bias of contact arm 64. Thus, when the heated drying option is selected, inhibit member 74 does not prevent actuation of heater switch 62 by cam surface 54.

To select the energy-saving drying option, the user moves control handle 82 to the right to its active position (FIGS. 5 and 6). When handle 82 is in this position, spring 84 is extended, biasing cam follower 78 of inhibit member 74 into cam-following engagement with inhibit cam surface 56. When so biased, movement of inhibit member 74 is controlled by inhibit cam surface 56. In FIG. 5, cam surface 56 holds inhibit member 74 in its clear position in which inhibit arm 80 is remote from inhibit tab 73 permitting switch arm 64 to follow cam surface 54. As the operating cycle progresses to the drying cycle, cam follower 78 drops over shoulder 56*a* of cam surface 56 pivoting inhibit member 74 to its inhibit position as shown in FIG. 5. In its inhibit position, inhibit member 80 engages tab 73 preventing contact arm 64 from dropping into contact with contact arm 66. Shoulder 54*a* of cam surface 54 has already passed beneath cam follower 72 of switch arm 64. The engagement between inhibit member 80 and tab 73 prevents actuation of switch 62 by cam surface 54.

In addition to enabling energization of the heating element during the wash cycle, regardless of which drying option is selected, this aspect of the invention also permits the provision of an energy-saving option in which the heater is energized during some predetermined portion of the drying cycle or intermittently during the drying cycle, so that a drying option between fully heated and totally non-heated drying could be provided.

While in accordance with the Patent Statues specific embodiments of the invention have been illustrated and described herein, it is realized that numerous modifications and changes will occur to those skilled in the art. It is therefore to be understood that the appended claims are intended to cover all such modifications and changes as fall within the spirit and scope of the invention.

What is claimed is:

1. An electromechanical timer comprising:

a housing;

a control cam rotatably mounted in said housing, said control cam comprising a plurality of cam surfaces;

a timer motor mounted in said housing for rotating said control cam;

a plurality of cam-actuated switches mounted in said housing for actuation by associated ones of said cam surfaces, said cam surfaces being contoured to provide predetermined sequential actuation of said associated ones of said switches;

option selection means manually movable between a first position and a second position and operative in its first position to inhibit cam actuation of at least one of said plurality of cam-actuated switches and in its second position to enable cam actuation of said one switch;

whereby said predetermined sequential actuation of said one switch is prevented when said selection means is in its first position and permitted by user placement of said selection means is in its second position.

2. A timer in accordance with claim 1 wherein said one switch includes first and second resilient contact arms, a contact mounted on each of said arms, and a first cam follower extending from said first arm, said cam follower being normally biased into engagement with a first one of said plurality of cam surfaces and movable by said one cam surface between an open position apart from said other contact arm and a closed position in engagement with said other contact arm;

and wherein said option selection means comprises an inhibit member constructed and arranged to engage said first contact arm and prevent said arm from moving to its closed position when said option selection means is in its first position and to disengage said first contact arm when said option selection means is in its second position, thereby permitting said first contact arm to follow said first cam surface.

3. The timer of claim 2 wherein said option selection means further comprises a selection member arranged for manual movement between an acitive position corresponding to said first position and an idle position corresponding to said second position and wherein said inhibit member comprises a rigid member projecting from said selection member, said rigid member extending into the path of said first contact arm to inhibit movement of said arm to its closed position when said selection member is in its active position, said rigid member being remote from said first contact arm when said selection means is in its idle position.

4. The timer of claim 2 wherein said inhibit member is pivotally mounted for movement between an inhibit position and a clear position, said inhibit member being operative in its inhibit position to inhibit actuation of said one switch by engaging said first contact arm and thereby holding said first contact arm in its open position, and said inhibit member being operative in its clear position to disengage said tab, thereby permitting said first contact arm to follow said associated cam surface.

5. The timer of claim 4 wherein said inhibit member further comprises a second cam follower extending therefrom for cam-following engagement with a second one of said plurality of cam surfaces; and wherein said option selection means comprises a manually operable selection member movable between an active position and an idle position corresponding respectively to said first and second positions of said option selection means and bias means for coupling said selection member and said inhibit member, said bias means being operative to bias said second cam follower into cam-following engagement with said second cam surface when said selection member is in its active position, whereby when said selection member is in its active position, movement of said inhibit member to its inhibit position is controlled by said second cam surface.

6. The timer of claim 3 or 5 wherein said selection member is mounted for sliding movement between its active position and its idle position.

7. An electromechanical timer for controlling the sequential operation of an appliance comprising:

a housing;

a control cam rotatably mounted in said said housing, said control cam comprising a plurality of switch-actuating cam surfaces and at least one inhibit cam surface;

a timer motor mounted in said housing for rotatably driving said control cam;

a plurality of cam-actuated switches mounted in said housing for actuation by associated ones of said cam surfaces, said cam surfaces being contoured to provide predetermined sequential actuation of associated ones of said cam switches;

option selection means for enabling user selection between first and second operating cycle options;

inhibit means coupled to said option selection means, and operative when said first operating option is selected to move between an inhibit position and a clear position under the control of said inhibit cam surface, said inhibit means being operative in its inhibit position to inhibit cam actuation of at least one of said plurality of cam-actuated switches by its associated cam surface and in its clear position to enable such cam actuation of said one switch, said inhibit means being operative when said second operating cycle option is selected to enable actuation of said one switch in response to its associated cam surface.

8. An electromechanical timer in accordance with claim 7 wherein said inhibit means comprises:

an inhibit member mounted in said housing for movement between an inhibit position in which said inhibit member engages said one switch so as to prevent cam actuation of said one switch and a clear position disengaged from said one switch;

bias means coupling said inhibit member and said option selection means and operative to bias said inhibit member into cam-following engagement with said inhibit cam surface when said first operating cycle option is selected and to relax said bias when said second operating cycle option is selected;

said inhibit cam surface being operative to move said inhibit member between said inhibit position and said clear position in a predetermined sequence when said inhibit member is biased into cam-following engagement therewith; said inhibit member permitting actuation of said one switch by its associated cam surface when said bias is relaxed, whereby when said first operating condition is selected cam actuation of said one switch means is sequentially inhibited under the control of said inhibit cam surface, and when said second operating condition is selected cam actuation of said one switch is not inhibited.

9. An electromechanical timer for controlling the sequential operation of a dishwashing appliance incorporating a heating element and providing the use with a choice of heated or energy-saving drying cycle options, said timer comprising:

a housing;

a control cam rotatably mounted in said housing, said control cam comprising a plurality of switch-actuating cam surfaces and at least one inhibit cam surface;

a timer motor mounted in said housing for rotatably driving said control cam;

a plurality of cam-actuated switches mounted in said housing for actuation by associated ones of said switch-actuating cam surfaces, said switch-actuating cam surfaces being contoured to provide predetermined sequential actuation of associated ones of said cam switches;

option selection means for enabling user selection between first and second appliance operating cycle options;

an inhibit member mounted in said housing for movement between an inhibit position in which said inhibit member engages one of said cam-actuated switches so as to prevent cam actuation of said one switch, and a clear position disengaged from said one switch; and bias means coupling said option selection means to said inhibit member and operative to bias said inhibit member into cam-following engagement with said inhibit cam surface when said first operating cycle option is selected and to relax said bias when said second operating cycle option is selected;

said inhibit cam surface being contoured to move said inhibit member between said inhibit position and said clear position in a predetermined sequence when said inhibit member is biased into cam following engagement therewith, said inhibit member permitting cam actuation of said one switch by its associated switch-actuating cam surface when said bias is relaxed, whereby when said first operating cycle option is selected cam actuation of said one switch means is sequentially inhibited under control of said inhibit cam surface, and when said second operating cycle option is selected, cam actuation of said one switch is not inhibited.

10. An electromechanical timer in accordance with claim 8 or 9 wherein said option selection means comprises a selection member constructed and arranged for manual movement between an active position corresponding to selection of said first appliance operating cycle option and an idle position corresponding to selection of said second appliance operating cycle option, and wherein said bias means comprises spring means linking said selection member and said inhibit member.

11. The electromechanical timer of claim 9 wherein said one switch is adapted for controlling energization of the dishwasher heating element and wherein said first operating cycle option is the energy-saving drying cycle option and said second operating cycle option is the heated drying cycle option.

* * * * *